US010392577B2

(12) United States Patent
Waynick

(10) Patent No.: US 10,392,577 B2
(45) Date of Patent: Aug. 27, 2019

(54) COMPOSITION AND METHOD OF MANUFACTURING OVERBASED SULFONATE MODIFIED LITHIUM CARBOXYLATE GREASE

(71) Applicant: NCH Corporation, Irving, TX (US)

(72) Inventor: J. Andrew Waynick, Lantana, TX (US)

(73) Assignee: NCH CORPORATION, Irving, TX (US)

( * ) Notice: Subject to any disclaimer, the term of this patent is extended or adjusted under 35 U.S.C. 154(b) by 0 days.

(21) Appl. No.: 15/594,006

(22) Filed: May 12, 2017

(65) Prior Publication Data

US 2017/0335223 A1 Nov. 23, 2017

Related U.S. Application Data

(60) Provisional application No. 62/338,327, filed on May 18, 2016.

(51) Int. Cl.

| | |
|---|---|
| ***C10M 123/06*** | (2006.01) |
| ***C10M 125/10*** | (2006.01) |
| ***C10M 129/42*** | (2006.01) |
| ***C10M 129/44*** | (2006.01) |
| ***C10M 135/10*** | (2006.01) |
| ***C10M 169/06*** | (2006.01) |
| ***C10M 177/00*** | (2006.01) |

(52) U.S. Cl.

CPC ..... *C10M 135/10* (2013.01); *C10M 123/06* (2013.01); *C10M 125/10* (2013.01); *C10M 129/42* (2013.01); *C10M 129/44* (2013.01); *C10M 169/06* (2013.01); *C10M 177/00* (2013.01); *C10M 2201/062* (2013.01); *C10M 2203/1006* (2013.01); *C10M 2207/127* (2013.01); *C10M 2207/128* (2013.01); *C10M 2207/1256* (2013.01); *C10M 2207/1276* (2013.01); *C10M 2207/1285* (2013.01); *C10M 2209/084* (2013.01); *C10M 2215/064* (2013.01); *C10M 2219/046* (2013.01); *C10M 2219/0466* (2013.01); *C10M 2219/068* (2013.01); *C10M 2223/045* (2013.01); *C10N 2210/01* (2013.01); *C10N 2210/02* (2013.01); *C10N 2250/10* (2013.01)

(58) Field of Classification Search

CPC ..... C10N 2270/00; C10N 2230/52; C10N 2230/06; C10N 2220/082; C10N 2220/022; C10N 2250/10; C10N 2210/02; C10N 2210/01; C10M 2219/046

USPC ..... 508/391

See application file for complete search history.

(56) References Cited

U.S. PATENT DOCUMENTS

| | | | |
|---|---|---|---|
| 2,270,577 | A | 1/1942 | Bergstrom |
| 2,402,325 | A | 6/1946 | Griesinger |
| 2,418,894 | A | 4/1947 | McNab |
| 2,444,970 | A | 7/1948 | Zimmer |
| 2,485,861 | A | 10/1949 | Campbell |
| 2,501,731 | A | 3/1950 | Mertes |
| 2,535,101 | A | 12/1950 | Sproule |
| 2,540,533 | A | 2/1951 | Kolfenbach |
| 2,585,520 | A | 2/1952 | Van Ess |
| 2,616,904 | A | 11/1952 | Asseff |
| 2,616,905 | A | 11/1952 | Asseff |
| 2,616,906 | A | 11/1952 | Asseff |
| 2,616,911 | A | 11/1952 | Asseff |
| 2,616,924 | A | 11/1952 | Asseff |
| 2,616,925 | A | 11/1952 | Asseff |
| 2,617,049 | A | 11/1952 | Asseff |
| 2,695,910 | A | 11/1954 | Asseff |
| 2,723,235 | A | 11/1955 | Asseff |
| 2,839,470 | A | 6/1958 | Warren |
| 2,861,951 | A | 11/1958 | Carlyle |
| 2,865,956 | A | 12/1958 | Ellis |
| 2,898,296 | A | 8/1959 | Pattenden et al. |
| 2,920,105 | A | 1/1960 | Kluge |
| 2,937,991 | A | 5/1960 | Carlyle |
| 2,940,930 | A | 6/1960 | Pattenden et al. |
| 2,956,018 | A | 10/1960 | Carlyle |
| 2,967,151 | A | 1/1961 | Morway |
| 2,977,301 | A | 3/1961 | Bergen |

(Continued)

FOREIGN PATENT DOCUMENTS

| | | |
|---|---|---|
| CN | 101153239 | 4/2008 |
| CN | 101993767 | 3/2011 |

(Continued)

OTHER PUBLICATIONS

Kobylyanskli, E.V., Structure of Ultrabasic Sulfonate Greases:, Chem. and Tech. of Fuels and Oils, 2002, 38(2).

(Continued)

*Primary Examiner* — Vishal V Vasisth

(74) *Attorney, Agent, or Firm* — Ross Barnes LLP; Robin L. Barnes

(57) ABSTRACT

An overbased sulfonate modified lithium carboxylate grease composition and method of manufacture comprising overbased calcium sulfonate, overbased magnesium sulfonate, or both added to a source of lithium hydroxide, base oil, and optionally one or more acids when a complex grease is desired. When overbased sulfonate is added, the amount of dicarboxylic acid relative monocarboxylic acid may be reduced. Additionally, the amount of lithium hydroxide added may be less than stoichiometrically needed to react with the acids. A sulfonate modified lithium grease with improved thickener yield and dropping point may be made without multiple heating and cooling cycles or using a pressurized kettle.

46 Claims, No Drawings

(56) References Cited

U.S. PATENT DOCUMENTS

| | | | |
|---|---|---|---|
| 2,978,410 | A | 4/1961 | Fullerton |
| 3,027,325 | A | 3/1962 | McMillen |
| 3,057,896 | A | 10/1962 | Schlight et al. |
| 3,150,088 | A | 9/1964 | Hunt et al. |
| 3,186,944 | A | 6/1965 | Dreher |
| 3,242,079 | A | 3/1966 | McMillen |
| 3,372,115 | A | 3/1968 | McMillen |
| 3,376,222 | A | 4/1968 | McMillen |
| 3,377,283 | A | 4/1968 | McMillen |
| 3,492,231 | A | 1/1970 | McMillen |
| 3,537,996 | A | 11/1970 | Holst |
| 3,655,558 | A | 4/1972 | Geyer et al. |
| 3,661,622 | A | 5/1972 | Rogers |
| 3,671,012 | A | 6/1972 | Scott |
| 3,679,584 | A | 7/1972 | Hellmuth |
| 3,681,242 | A | 8/1972 | Gilani et al. |
| 3,746,643 | A | 7/1973 | Rogers |
| 3,791,973 | A | 2/1974 | Gilani et al. |
| 3,816,310 | A | 6/1974 | Hunt |
| 3,850,823 | A | 11/1974 | Kjonaas |
| 3,907,691 | A | 9/1975 | King et al. |
| 3,929,650 | A | 12/1975 | King et al. |
| 3,940,339 | A | 2/1976 | Clarke, Jr. et al. |
| 4,297,227 | A | 10/1981 | Witte et al. |
| 4,376,060 | A | 3/1983 | Stadler |
| 4,435,299 | A | 3/1984 | Carley et al. |
| 4,444,669 | A | 4/1984 | Wittse, Jr. et al. |
| 4,483,775 | A | 11/1984 | Yamaguchi |
| 4,560,489 | A | 12/1985 | Muir |
| 4,597,880 | A | 7/1986 | Eliades |
| 4,728,578 | A | 3/1988 | Higgins et al. |
| 4,744,920 | A | 5/1988 | Fischer et al. |
| 4,780,224 | A | 10/1988 | Jao |
| 4,787,992 | A | 11/1988 | Waynick |
| 4,810,396 | A | 3/1989 | Jao et al. |
| 4,810,398 | A | 3/1989 | Van Kruchten et al. |
| 4,824,584 | A | 4/1989 | Muir |
| 4,830,767 | A | 5/1989 | Waynick |
| 4,902,435 | A | 2/1990 | Waynick |
| 4,904,399 | A | 2/1990 | Waynick |
| 4,929,371 | A | 5/1990 | Waynick |
| 5,084,193 | A | 1/1992 | Waynick |
| 5,126,062 | A | 6/1992 | Barnes |
| 5,190,678 | A | 3/1993 | Swartz |
| 5,308,514 | A | 5/1994 | Olson |
| 5,338,467 | A | 8/1994 | Olson et al. |
| 6,172,122 | B1 | 1/2001 | Lawate et al. |
| 6,239,083 | B1 | 5/2001 | Muir |
| 6,432,889 | B1 | 8/2002 | Kinoshita et al. |
| 6,596,672 | B1 | 7/2003 | Carrick et al. |
| 6,869,111 | B2 | 3/2005 | Goto et al. |
| 6,875,731 | B1 | 4/2005 | Bence |
| 7,241,723 | B2 | 7/2007 | Zhang |
| 7,294,608 | B2 | 11/2007 | Oldiges |
| 7,517,837 | B2 | 4/2009 | Kurosky et al. |
| 9,273,265 | B2 | 3/2016 | Waynick |
| 9,458,406 | B2 | 10/2016 | Waynick |
| 2003/0111838 | A1 | 6/2003 | Goto et al. |
| 2005/0054541 | A1 | 3/2005 | Zhang et al. |
| 2005/0215442 | A1 | 9/2005 | Sivik et al. |
| 2006/0025317 | A1 | 2/2006 | Olson et al. |
| 2006/0223719 | A1 | 10/2006 | Riff et al. |
| 2007/0060485 | A1 | 3/2007 | Waynick |
| 2009/0305920 | A1 | 12/2009 | Kato et al. |
| 2011/0021391 | A1 | 1/2011 | E et al. |
| 2011/0048809 | A1 | 3/2011 | Duckworth |
| 2011/0092404 | A1 | 4/2011 | Zhang et al. |
| 2011/0136709 | A1 | 6/2011 | Tanaka et al. |
| 2011/0160105 | A1 | 6/2011 | Tanaka et al. |
| 2011/0190177 | A1 | 8/2011 | Zaki |
| 2011/0195880 | A1 | 8/2011 | Kawamura et al. |
| 2011/0233473 | A1 | 9/2011 | Fletcher |
| 2013/0109602 | A1 | 5/2013 | Waynick |
| 2014/0121139 | A1 | 5/2014 | Waynick |
| 2016/0115416 | A1 | 4/2016 | Waynick |

FOREIGN PATENT DOCUMENTS

| | | |
|---|---|---|
| CN | 102051257 | 5/2011 |
| CN | 102634400 | 8/2012 |
| CN | 103952215 | 7/2014 |
| GB | 816318 | 7/1959 |
| GB | 1239860 | 7/1971 |
| JP | 2004346120 | 12/2004 |
| JP | 2007084620 | 4/2007 |
| JP | 2009286950 | 12/2009 |
| JP | 2009292918 | 12/2009 |
| JP | 2009298890 | 12/2009 |
| WO | WO2011098616 | 8/2011 |

OTHER PUBLICATIONS

Boner, C.J. Manufacture and Application of Lubricating Greases, 1954, p. 369, Hafner Publishing Company, Inc.

COMPOSITION AND METHOD OF MANUFACTURING OVERBASED SULFONATE MODIFIED LITHIUM CARBOXYLATE GREASE

CROSS-REFERENCE TO RELATED APPLICATION

This application claims the benefit of U.S. provisional patent application No. 62/338,327 filed May 18, 2016.

BACKGROUND OF THE INVENTION

1. Field of the Invention

This invention relates to lithium carboxylate greases made with the addition of a small amount of overbased calcium sulfonate, overbased magnesium sulfonate, or both.

2. Description of Related Art

Lithium carboxylate greases have been the largest category of lubricating greases worldwide for decades. Lithium carboxylate greases (sometimes called lithium soap greases) can either be simple lithium soap greases (most often lithium 12-hydroxystearate greases) or they can be lithium complex greases. Simple lithium soap greases are most often made by reacting 12-hydroxystearic acid with at least a stoichiometric amount of a source of lithium hydroxide (usually lithium hydroxide monohydrate, which is an expensive ingredient) and some solvent water in an initial portion of the base oil to be used in the final grease. Early lithium soap greases used stearic acid instead of 12-hydroxystearic acid. The reaction mixture is typically heated to about 400 F (where the thickener melts) and then cooled to reform the simple lithium soap thickener. A slight stoichiometric excess of lithium hydroxide is typically used so as to insure that all acids are reacted. Additional base oil and additives as required are added. The final grease is usually milled to optimally disperse the thickener and provide a smooth and homogenous product. Dropping points of such greases are typically 380 F to about 400 F or slightly higher.

Lithium complex greases were developed as an improvement over simple lithium soap greases, where the primary property being improved was dropping point. In these greases, a dicarboxylic acid, usually adipic, sebacic, or (preferably) azelaic acid is also used. The dicarboxylic acid is typically called the complexing acid. The lithium hydroxide monohydrate is reacted with both 12-hydroxystearic acid (the primary thickener acid) and the dicarboxylic acid in such a way as to get a thickener system where the resulting lithium 12-hydroxystearate and di-lithium azelate (in the case of azelaic acid being used, for example) are associated at the molecular level to the extent that the high melting point properties of the di-lithium azelate are imparted to the overall complex thickener system. This results in a greatly increased dropping point. Typical dropping points are at least 500 F. As with simple lithium soap greases, a slight stoichiometric excess of lithium hydroxide is typically used so as to insure that all acids are reacted.

U.S. Pat. No. 2,898,296 discloses a lithium complex grease with a reported dropping point above 500 F. In the '296 patent, lithium hydroxide monohydrate was added to a blend of base oil, stearic acid, and a diester of sebacic acid and heated to about 400 F. The resulting grease had a dropping point that ranged from 479 F to >500 F, depending on the ratio of the stearic acid to the sebacic diester. During the reaction of the lithium hydroxide, the alcohol group associated with the sebacic acid diester was released to the atmosphere. This may have not been an issue in 1959 when the '296 patent issued, but venting of volatile alcohols would be an environmental concern and prohibited in many areas of the world today. The highest dropping point taught in the '296 patent occurred when the ratio of the stearic acid to the sebacic diester was 1.0. The '296 patent also taught that if the same grease was made using sebacic acid instead of the diester, a grainy product was formed with a dropping point of only about 360 F. The grainy texture was attributed to the di-lithium sebacate that had not been intimately incorporated into the lithium 12-hydroxystearate thickener structure. Based on the teachings of the '296 patent, it appears that the presence of the ester moieties and/or the transient presence of the released alcohol acted as a coupling agent to assist in the intimate association of the lithium 12-hydroxystearate and the di-lithium sebacate as they formed, thereby increasing the dropping point.

U.S. Pat. No. 2,940,930 also teaches a lithium complex grease. In the '930 patent, a mixture of stearic and dicarboxylic acid (adipic, sebacic, or azelaic acid) was heated with a polyhydric alcohol (glycol) to about 350 F to form a reacted product (likely a complex ester). That product was cooled, added to base oil, and reacted with lithium hydroxide monohydrate by heating to at least 300 F. The grease formed had a dropping point greater than 500 F. The preferred wt/wt ratio of stearic acid to azelaic acid was 1.5. Although not specifically mentioned in the '930 patent, the final reaction of lithium hydroxide with the initial reaction product of the acids and the glycol (di-alcohol) would likely generate alcoholic material that would be undesirably released to the atmosphere or retained as an undesirable bi-product. The method of the '930 patent also requires two heating and cooling cycles, which adds to the time and expense of manufacturing the grease.

Another lithium complex grease is disclosed in U.S. Pat. No. 3,681,242. In the '242 patent, an aqueous solution of lithium hydroxide was added to 12-hydroxystearic acid in base oil and heated to about 400-430 F to form the lithium 12-hydroxystearate. The simple lithium soap grease was cooled to about 220 F. Then the complexing acid, preferably azelaic acid, was added. Additional aqueous lithium hydroxide was added to react with the azelaic acid, and the mixture was once again heated to 350-375 F. The product was then cooled and finished as a lithium complex grease. The dropping point was reported as high as 540 F, and the wt/wt ratio of 12-hydroxystearic acid to azelaic acid ranged from 1.6 to 2.95. The method of the '242 patent also requires two heating and cooling cycles, which adds to the expense of manufacturing the grease.

In a similar patent, U.S. Pat. No. 3,791,973, a process where the 12-hydroxystearic acid in base oil is reacted with aqueous lithium hydroxide and dehydrated by heating to 300 F is disclosed. The product was then cooled to no lower than 205 F. Azelaic acid was then added and reacted with additional aqueous lithium hydroxide. The mixture was then heated again to 390 F and cooled. The resulting lithium complex grease had a dropping point of 625 F. The preferred wt/wt ratio of 12-hydroxystearic acid to azelaic acid ranged from 2.0 to 3.2. Again, this method required multiple heating and cooling steps.

The use of two heating and cooling steps was avoided in the method disclosed in U.S. Pat. No. 4,435,299. The multiple heating and cooling steps are avoided by a slow metered addition of aqueous lithium hydroxide to a blend of 12-hydroxystearic and azelaic acids in base oil with the temperature being held below the boiling point of water. Once the reaction was complete, the product was heated to 390-400 F and then rapidly quenched to 375 F by addition of more base oil. The lithium complex grease was then cooled and finished. The dropping point was greater than 500 F, and the preferred wt/wt ratio of 12-hydroxystearic acid to azelaic acid was 2.6 or lower.

Specialized equipment has also been designed to more efficiently make lithium complex greases. For example, U.S. Pat. No. 4,297,227 discloses equipment and related methods whereby greases can be continuously made. In U.S. Pat. No. 4,444,669, the same inventors applied this continuous grease making equipment and method to lithium complex greases. Likewise, lithium complex greases can be more efficiently made using closed pressurized kettles (sometimes referred to as autoclaves) and contactors. Contactors are a special closed vessel with cyclic flow and simultaneous high agitation that occurs throughout the entire reaction of aqueous lithium hydroxide and the two thickener acids in base oil. This process is continued through the entire heating (typically to about 400-430 F) and cooling. Good thickener yield and high dropping points are obtained with typically just one heating and cooling cycle. However, many grease manufacturing facilities do not have access to pressurized kettles or contactors.

There is a need in the art for a lithium complex grease composition and method of manufacture that results in a grease with a dropping point above 500 F, preferably above 540 F, and more preferably above 600 F that avoids using esters of 12-hydroxystearic acid or azelaic acid or any other processes that, if present, would generate alcohols that would either be released to the atmosphere, captured and disposed as hazardous waste, or retained in the grease with associated deleterious properties. There is also a need for such a high dropping point lithium complex grease that only requires one heating and cooling cycle during the manufacturing method and/or that can be made in an open vessel with typical heating and cooling capacity and does not require a pressurized kettle or contactor. There is also a need in the art to reduce the amount of azelaic acid and lithium hydroxide used to make a lithium grease, as these are very expensive ingredients. Azelaic acid costs 4 to 5 times as much as 12-hydroxstearic acid. Additionally, it takes 4 times the amount of lithium hydroxide to neutralize azelaic acid compared to 12-hydroxystearic acid. It has not previously been known to make a lithium grease using a wt/wt ratio of 12-hydroxystearic acid to azelaic acid of 3.2 or higher. It has also not been previously known to simultaneously add the 12-hydroxystearic acid and azelaic acid or add the 12-hydroxystearic acid followed by immediate sequential addition of azelaic acid in the lithium grease manufacturing process. It has also not previously been known to add magnesium sulfonate, calcium sulfonate, or both as an ingredient in a lithium grease composition.

SUMMARY OF THE INVENTION

This invention relates to lithium carboxylate greases modified with overbased magnesium sulfonate, overbased calcium sulfonate, or both. As used herein, a lithium carboxylate grease modified with magnesium sulfonate, overbased calcium sulfonate, or both is sometimes referred to simply as a lithium grease, which includes both simple lithium greases and complex lithium greases unless one or the other is specified.

According to one preferred embodiment, a lithium grease composition comprises a small amount of overbased magnesium sulfonate, overbased calcium sulfonate, or both. According to another preferred embodiment, a lithium grease composition comprises 12-hydroxystearic acid and azelaic acid in a wt/wt ratio of at least 3.2, more preferably at least 5, and most at least 5.8. According to another preferred embodiment, a lithium grease composition comprises 1-5% lithium hydroxide monohydrate. According to another preferred embodiment of the invention, the amount of lithium hydroxide source may be lower than the stoichiometric amount needed for reaction with the 12-hydroxystearic and azelaic acids. The grease compositions according to preferred embodiments of the invention have dropping points above 500 F, more preferably above 540 F, and most preferably above 600 F. The grease compositions according to preferred embodiments also do not require the use of esters that generate undesirable volatile alcohol by-products or contaminants. Similarly, these grease compositions do not require multiple heating and cooling cycles (as defined below) during manufacture, even when not using pressurized kettles or contactors.

According to one preferred method of making a lithium grease, a small amount of overbased magnesium sulfonate, overbased calcium sulfonate, or both is added to the initial base oil before adding the acids or the source of lithium hydroxide (usually lithium hydroxide monohydrate). According to another preferred embodiment, only one heating and cooling cycle is used to make a lithium grease. As used herein a heating and cooling cycle refers to heating and then cooling a mixture of various ingredients in the grease making process. For example, heating to a first range of temperatures, then heating to a second range of temperatures, then cooling to a third range of temperatures without any cooling between the two heating steps is considered one heating and cooling cycle. Heating to a first range of temperatures, cooling to a second range of temperatures, then heating to a third range of temperatures, and cooling to a fourth range of temperatures is considered two heating and cooling cycles. According to yet another preferred embodiment, a lithium grease is manufactured in an open vessel or kettle, and a closed, pressurized kettle is not needed. According to yet another preferred embodiment, the 12-hydroxystearic acid and azelaic acid may be added simultaneously or the 12-hydroxystearic acid added followed by the immediate sequential addition of the azelaic acid. According to yet another preferred embodiment, it is not necessary to add the lithium hydroxide by slow metered addition.

The preferred embodiments of the lithium grease compositions and methods of the invention provide several benefits and advantages. These include that significantly higher dropping points, preferably at least 540 F and more preferably at least 600 F or higher, may be achieved. The amounts of azelaic acid and lithium hydroxide (both expensive ingredients) used are reduced. The manufacturing process is simplified by allowing a grease batch to be heated to top processing temperature (usually about 390 F-430 F) only once and using only one heating and cooling cycle, even when using open kettles instead of pressurized kettles of contactors. The process is also simplified by the 12-hydroxystearic acid and azelaic acid to be preferably added at the same time or near the same time and by not requiring slow metered addition of the lithium hydroxide.

DESCRIPTION OF THE PREFERRED EMBODIMENTS

According to one preferred embodiment of the invention, a simple or complex lithium grease composition is provided comprising (1) overbased calcium sulfonate, overbased magnesium sulfonate, or both; (2) base oil; (3) water; and (4) a source of lithium. The preferred source of lithium is lithium hydroxide, but other sources such as anhydrous lithium hydroxide, if available, may be used. Any material that will react during the grease manufacturing process at the correct time to generate lithium hydroxide in-situ may also be used, provided that no undesirable byproducts are generated. Most preferably, the lithium hydroxide is a solid, stable monohydrate. It is noted that when the lithium hydroxide monohydrate is dissolved in water, the water of hydration is simply incorporated into the water solvent as the lithium hydroxide dissociates into its substituent aqueous lithium cations and hydroxide anions. After the lithium complex grease is finished, all water is lost. Any excess lithium hydroxide should then be present as the anhydrous form. When discussing the dissolving and reaction of lithium hydroxide monohydrate with the thickener acids according to various preferred embodiments herein, the terms "lithium hydroxide monohydrate" and "lithium hydroxide" are used interchangeably.

The highly overbased oil-soluble calcium sulfonate (also referred to herein as simply "calcium sulfonate" or "overbased calcium sulfonate" for brevity) used according to these embodiments of the invention can be any typical to that documented in the prior art, such as U.S. Pat. Nos. 4,560,489; 5,126,062; 5,308,514; and 5,338,467. The highly overbased oil-soluble calcium sulfonate may be produced in situ according to such known methods or may be purchased as a commercially available product. Such highly overbased oil-soluble calcium sulfonates will have a Total Base Number (TBN) value not lower than 200, preferably not lower than 300, and most preferably about 400 or higher. Commercially available overbased calcium sulfonates of this type include, but are not limited to, the following: Hybase C401 as supplied by Chemtura USA Corporation; Syncal OB 400 and Syncal OB405-WO as supplied by Kimes Technologies International Corporation; Lubrizol 75GR, Lubrizol 75NS, Lubrizol 75P, and Lubrizol 75WO as supplied by Lubrizol Corporation. The overbased calcium sulfonate contains around 28% to 40% dispersed amorphous calcium carbonate by weight of the overbased calcium sulfonate, which is converted to crystalline calcium carbonate during the process of making the calcium sulfonate grease. The overbased calcium sulfonate also contains around 0% to 8% residual calcium oxide or calcium hydroxide by weight of the overbased calcium sulfonate. Most commercial overbased calcium sulfonates will also contain around 40% base oil as a diluent, to keep the overbased calcium sulfonate from being so thick that it is difficult to handle and process. The amount of base oil in the overbased calcium sulfonate may make it unnecessary to add additional base oil (as a separate ingredient) prior to conversion to achieve an acceptable grease.

The overbased calcium sulfonate used may be of a "good" quality or a "poor" quality as defined herein and in U.S. Pat. No. 9,458,406. Certain overbased oil-soluble calcium sulfonates marketed and sold for the manufacture of calcium sulfonate-based greases can provide products with unacceptably low dropping points when prior art calcium sulfonate grease technologies are used. Such overbased oil-soluble calcium sulfonates are referred to as "poor quality" overbased oil-soluble calcium sulfonates throughout this application. When all ingredients and methods are the same except for the commercially available batch of overbased calcium sulfonate used, overbased oil-soluble calcium sulfonates producing greases having higher dropping points (above 575 F) are considered to be "good" quality calcium sulfonates for purposes of this invention and those producing greases having lower dropping points are considered to be "poor" quality for purposes of this invention. Several examples of this are provided in the '406 patent, which is incorporated by reference. Although comparative chemical analyses of good quality and poor quality overbased oil-soluble calcium sulfonates has been performed, it is believed that the precise reason for this low dropping point problem has not been proven. While many commercially available overbased calcium sulfonates are considered to be good quality, it is desirable to achieve acceptable greases regardless of whether a good quality or a poor quality calcium sulfonate is used. It has been found that both improved thickener yield and higher dropping point may be achieved with either a good quality or a poor quality calcium sulfonate in the lithium grease composition and methods according to the invention.

The overbased magnesium sulfonate (also referred to herein as simply "magnesium sulfonate," for brevity) used according to these embodiments of the invention can be any typical to that documented or known in the prior art. The overbased magnesium sulfonate may be made in-situ or any commercially available overbased magnesium sulfonate may be used. Overbased magnesium sulfonate will typically comprise a neutral magnesium alkylbenzene sulfonate and an amount of overbasing wherein a substantial amount of that overbasing is in the form of magnesium carbonate. The magnesium carbonate is believed to typically be in an amorphous (non-crystalline) form. There may also be a portion of the overbasing that is in the form of magnesium oxide, magnesium hydroxide, or a mixture of the oxide and hydroxide. The total base number (TBN) of the overbased magnesium sulfonates is preferably at least 400 mg KOH/gram, but lower TBN values may also be acceptable and in the same ranges as indicated for the TBN values for the overbased calcium sulfonate above.

Calcium sulfonate and magnesium sulfonate may be used separately or together in any proportion relative to each other according to various preferred embodiments. These sulfonates ("overbased sulfonate" or simply "sulfonate" are used herein to refer to either calcium sulfonate or magnesium sulfonate) do not appear to convert to any functionally significant extent during their use in various preferred embodiments of the invention. The conversion process, as described in U.S. Pat. Nos. 9,273,265 and 9,458,406, does not appear to be a part of the unexpectedly beneficial function of the overbased sulfonates in the various preferred embodiments of the invention. The overbased magnesium sulfonates appear to only slightly convert when used to make lithium greases. However, this property of overbased sulfonates is not a limitation in making lithium greases according to the compositions and methods of the preferred embodiments of the invention. Without being bound by theory, it appears that the overbased sulfonate is dispersing the initially formed aqueous lithium hydroxide solution to facilitate its reaction with the thickener acids, thereby further preventing the reaction of the thickener acids with the overbased sulfonate. The overbased sulfonate apparently also promotes the intimate association of the lithium 12-hydroxystearate and di-lithium azelate as they are formed, thereby eliminating the need for esters, alcohols, or multiple heating and cooling cycles as a means of imparting a high dropping point.

Any petroleum-based naphthenic or paraffinic mineral oils commonly used and well known in the grease making art may be used as the base oil according to the invention.

Base oil is added as needed, since most commercial overbased calcium sulfonates will already contain about 40% base oil as a diluent so as to prevent the overbased sulfonate from being so thick that it cannot be easily handled. Similarly, overbased magnesium sulfonate will likely contain base oil as a diluent. With the amount of base oil in the overbased calcium sulfonate and overbased magnesium sulfoante, it may be unnecessary to add additional base oil depending on the desired consistency of the grease. Synthetic base oils may also be used in the greases of the present invention. Such synthetic base oils include polyalphaolefins (PAO), diesters, polyol esters, polyethers, alkylated benzenes, alkylated naphthalenes, and silicone fluids. In some cases, synthetic base oils may have an adverse effect if present during the conversion process as will be understood by those of ordinary skill in the art. In such cases, those synthetic base oils should not be initially added, but added to the grease making process at a stage when the adverse effects will be eliminated or minimized, such as after conversion. Naphthenic and paraffinic mineral base oils are preferred due to their lower cost and availability. Combinations of different base oils as described above may also be used in the invention, as will be understood by those with ordinary skill in the art.

According to another preferred embodiment, a complex lithium grease composition comprises ingredients (1)-(4) above and further comprises a thickener acid and a complexing acid. Most preferably, the primary thickener acid is 12-hydroxystearic acid, but any alkyl C16 to C22 monocarboxylic acid or a mixture of such may be used. The primary thickener acid (or acids) may have a hydroxy group covalently attached to one of the non-carboxylic carbons or it may have no hydroxy group. Most preferably, the complexing acid is azelaic acid, but any alkyl C6 to C12 dicarboxylic acid or a mixture of such may be used.

According to another preferred embodiment of the invention, less azelaic acid (or other dicarboxylic acid) is used relative to the amount of 12-hydroxystearic acid (or other monocarboxylic acid). Without being bound by theory, it is believed that adding a small amount of overbased sulfonate allows the use of less azelaic acid relative to the 12-hydroxystearic acid. This is important since it is the 12-hydroxystearic acid that imparts good thickener yield. Azelaic acid is not good for thickener yield, but does raise the dropping point. Prior art lithium complex greases must compromise in how the relative amounts of 12-hydroxystearic acid and azelaic acid are added. More 12-hydroxystearic acid and less azelaic acid give better thickener yield but lower dropping point. Less 12-hydroxystearic acid and more azelaic acid give higher dropping point but poorer thickener yield. Adding an overbased sulfonate according to preferred embodiments of the invention allows the best of both worlds by allowing less azelaic acid relative to the 12-hydroxystearic acid while still providing good thickener yields and dropping points. In fact, the dropping points are not only good but even higher than many prior art lithium complex greases. Additionally, azelaic acid is about five times as costly as 12-hydroxystearic acid, so lowering the relative amount of azelaic acid to 12-hydroxystearic acid according to various preferred embodiments of the invention reduces the cost of the final grease.

According to another preferred embodiment of the invention, the amount of lithium hydroxide source may be lower than the stoichiometric amount needed for reaction with the 12-hydroxystearic and azelaic acids (or other monocarboxylic and dicarboxylic acids). The additional base needed for reaction with the acids may be from the overbased sulfonate or may be from a small amount of optionally added calcium containing base, such as added calcium hydroxide, added calcium oxide, added calcium carbonate, calcium hydroxyapatite, or a mixture of two or more of these materials. This is important since lithium hydroxide is an expensive ingredient, so it is beneficial to reduce the amount of lithium hydroxide used. The amount of lithium hydroxide according to a preferred embodiment of the invention is reduced relative to prior art lithium carboxylate greases while still maintaining good thickener yield and improved dropping point. If one or more calcium containing bases are added, they are preferably finely divided with a mean particle size of around 1 to 20 microns, preferably around 1 to 10 microns, most preferably around 1 to 5 microns. Furthermore, any calcium containing base is preferably of sufficient purity so as to have abrasive contaminants such as silica and alumina at a level low enough to not significantly impact the anti-wear properties of the resulting grease. Ideally, for best results, any calcium containing base should be either food grade or U.S. Pharmacopeia grade.

According to several preferred embodiments, a lithium grease composition comprises the following ingredients by weight percent of the final grease product (although some ingredients, such as water, sulfonates, and acids, may not be in the final grease product or may not be in the concentrations indicated for addition):

TABLE 1

| Preferred Compositions | | | |
|---|---|---|---|
| Ingredient | Preferred Amount (%) | More Preferred Amount (%) | Most Preferred Amount (%) |
| Overbased Calcium Sulfonate | 0.01-10 | 0.1-5 | 0.2-2 |
| Overbased Magnesium Sulfonate | 0.01-10 | 0.1-5 | 0.2-2 |
| Lithium Hydroxide Monohydrate | 1-5 | 1.2-3.6 | 2-3 |
| 12-Hydroxystearic Acid (or other monocarboxylic acid) | 4.3-21.2 | 5.2-15.3 | 8.6-12.8 |
| Azelaic Acid (or other dicarboxylic acid) | 0.8-3.6 | 0.9-2.6 | 1.6-2.2 |
| Base Oil (total) | 50.2-93.9 | 68.5-92.5 | 78-87.4 |
| Water (added) | 0.1-10 | 0.5-5 | 1-3 |
| Ratio of 12-HSA (or other monocarboxylic acid)/Azelaic Acid (or other dicarboxylic acid (wt/wt) | 1-<10 | 2-8 | 3.2-6 |
| Ratio of 12-HSA (or other monocarboxylic acid)/Overbased sulfonate (wt/wt) | <1-1000 | 2-100 | 3.3-50 |
| Excess Lithium Hydroxide, Anhydrous | 0.01-0.22 | 0.03-0.18 | 0.07-0.15 |

All percentages are based on the total unreacted weight of all ingredients (raw materials) in the grease, not including water. Water will not be present in the final grease since both the added water and the water of reaction will be evaporated during the manufacturing process. Even so, the percentages of added water are based on the total unreacted weight of the grease, not including the added water. Other ingredients, such as sulfonates and acids, may not be in the final finished grease product or may not be in the final grease product in the amounts indicated for addition as an ingredient, due to evaporation, volatilization, or reaction with other ingredients during manufacture. These amounts are when a grease is made in an open vessel. Even smaller amounts of may be used when a lithium grease is made in a pressure vessel. Although it is preferred to make lithium greases in an open vessel, a pressurized kettle or contactor may be used according to the invention. The widest ranges of the thickener components in the above table take into account the applicability of the subject invention as it would include final greases with NLGI consistency grades spanning 000 to 3.

According to one preferred method for making a lithium grease, the method comprises the following steps: (1) adding an initial portion of the base oil and the overbased sulfonate (magnesium, calcium, or both) and begin mixing; (2) adding the lithium hydroxide monohydrate and water; (3) heating the mixture to about 160 F-200 F, most preferably around 180 F; (4) adding the monocarboxylic and dicarboxylic acids, preferably 12-hydroxystearic and azelaic acids; (5) heating the mixture to about 190-200 F and holding the mixture in that temperature range until the reaction is complete; and (6) heating the mixture to 390-430 F and then cooling the mixture.

According to this preferred embodiment, it is not necessary to heat, cool, re-heat, and re-cool the mixture—it may be heated in multiple stages without intermediate cooling and cooled only once at the end of the process for a total of one heating and cooling cycle. The order of addition of the lithium hydroxide and water in step (2) is not important, and a pre-dissolved aqueous solution of lithium hydroxide may be used if desired. The order of addition of the acids in step (4) is not critical, although adding the monocarboxylic acid (12-hydroxystearic acid) first is preferred. The order of steps (1)-(5) relative to each other is not critical, but it is preferred that they be carried out in the order indicated numerically. It is noted that prior art lithium grease processes teach the addition of the thickener acids before the lithium hydroxide, whereas it is preferred to add them after the lithium hydroxide in various embodiments of the invention. For fully additized lithium complex greases, the final processing steps after heating to the maximum processing temperature are the same as with any prior art grease. They include cooling the grease to a temperature that is appropriate for the addition of any additives are used, and milling to optimize the thickener dispersion, texture smoothness, and any other properties associated with optimized thickener dispersion. Most preferably, the preferred compositions according to the invention are made using the preferred methods according to the invention.

According to another preferred embodiment, the acids in step (4) are added at substantially the same time (substantially simultaneously, recognizing that adding each ingredient takes at least some time and cannot occur instantaneously and that it may take longer to add the larger amount of monocarboxylic acid than the smaller amount of dicarboxylic acid according to one preferred embodiment). According to another preferred embodiment, the acids in step (4) are added sequentially without any heating or cooling between their additions and/or without any other ingredient being added between their additions. According to another preferred embodiment, the lithium hydroxide is added in a batch manner all at once (en masse, as opposed to a slow metered addition over time).

According to another preferred embodiment, the method comprises the steps above except that the sulfonate(s) are added after the thickener reaction and after heating to the maximum processing temperature. According to other preferred embodiments, a portion of one or both sulfonates may be added early in the process and another portion of the same or both sulfonates may be added later in the process. For example, a portion of magnesium sulfonate may be added prior to addition of the lithium hydroxide and another portion of magnesium sulfonate may be added after reaching maximum processing temperature and cooling. According to another preferred embodiment, all of the calcium sulfonate or magnesium sulfonate may be added prior to the addition of lithium hydroxide and all of the other sulfonate may be added after reaching maximum processing temperature and cooling. Various combinations of partial or total addition of one or both sulfonates at the beginning and end of the process may be used.

The overbased calcium magnesium sulfonate grease compositions and methods for making such compositions according to various embodiments the invention are further described and explained in relation to the following examples. The greases in Examples 1-4 are baseline example greases according to the prior art, for comparison with various preferred embodiments of the invention. Examples 1 and 2 use ratios within the ranges taught by the prior art and the overall grease making process is according to the prior art. Example 3 and 4 use increased ratios of 12-hydroxystearic acid to azelaic acid higher than taught in the prior art, but otherwise use the overall grease making process according to the prior art (with multiple heating and cooling cycles).

Example 1

A lithium complex base grease (grease with no additives except a minor amount of antioxidant) was prepared within the scope of previously described prior art methods involving the separate and sequential reaction of the two acids with lithium hydroxide monohydrate with two distinct heating and cooling steps. The wt/wt ratio of 12-hydroxystearic acid to azelaic acid was 2.89. The amount of stoichiometric excess lithium hydroxide in the final grease was 0.06% (wt).

This grease was made as follows: 740.35 grams of a solvent neutral group 1 paraffinic base oil having a viscosity of about 600 SUS at 100 F were added to an open mixing vessel. Then 7.48 grams of an aryl amine antioxidant were added, and mixing began using a planetary mixing paddle. The mixture was heated using a rheostat controlled electric heating mantle until the temperature was 180 F. Then 155.25 grams of 12-hydroxystearic acid were added and allowed to melt and mix into the mixture. At this point, 47.25 grams of lithium hydroxide monohydrate were added, and the mixture was heated to the range of 190-200 F. Then 12.67 grams water were added. The mixture was allowed to react for 30 minutes during which time it foamed. Although reaction of the acids with the base was clearly occurring, no visible grease structure had formed. After the 30 minutes, the mixture was heated to the range of 280-290 F and then cooled back down to 190-200 F. Cooling was accomplished by removing the heating mantle and stirring in open air. Then 53.70 grams of azelaic acid and 12.85 grams water were added. The batch was stirred for 30 minutes after which it was heated to 400-410 F. This heating step took over one hour to complete. When the target top temperature range was reached and held for 5 minutes, the heating mantle was removed and the batch was mixed in the open air and allowed to cool to 170 F. During this cooling period, as the grease structure formed and became increasingly heavy, six portions of the same paraffinic base oil totaling 660.72 grams were added and allowed to fully mix in. The entire batch was given three passes through a three roll mill with both gaps set at 0.001 inches. The final milled grease had a worked 60 stroke penetration of 280. The dropping point was 503 F.

Example 2

Another lithium complex base grease was made essentially the same as the previous Example 1 grease. The only difference was that when the grease had been heated to its top temperature range of 390-400 F, it was cooled to 250 F and then heated again to 390-400 F. Then the grease was cooled to 170 F. The wt/wt ratio of 12-hydroxystearic acid to azelaic acid was 2.89. The amount of stoichiometric excess lithium hydroxide in the final grease was 0.05% (wt).

The grease was made as follows: 745.24 grams of a solvent neutral group 1 paraffinic base oil having a viscosity of about 600 SUS at 100 F were added to an open mixing vessel. Then 7.45 grams of an aryl amine antioxidant were added, and mixing began using a planetary mixing paddle. The mixture was heated using a rheostat controlled electric heating mantle until the temperature was 180 F. Then 155.25 grams of 12-hydroxystearic acid were added and allowed to melt and mix into the mixture. At this point, 47.25 grams of lithium hydroxide monohydrate were added, and the mixture was heated to the range of 190-200 F. Then 12.5 grams water were added. The mixture was allowed to react for 30 minutes during which time it foamed. Although reaction of the acids with the base was clearly occurring, no visible grease structure had formed. After the 30 minutes, the mixture was heated to the range of 280-290 F and then cooled back down to 190-200 F. Cooling was accomplished by removing the heating mantle and stirring in open air. Then 53.70 grams of azelaic acid and 12.5 grams water were added. The batch was stirred for 30 minutes after which it was heated to 400-410 F. This heating step took over one hour to complete. When the target top temperature range was reached and held for 5 minutes, the heating mantle was removed and the batch was mixed in the open air and allowed to cool to 250 F. During this cooling period, as the grease structure formed and became increasingly heavy, two portions of the same paraffinic base oil totaling 231.94 grams were added and allowed to fully mix in. When the batch reached 250 F, it was once again heated to 400-410 F and held there for 5 minutes. Then it was allowed to cool in the same manner as before. As it was cooled to 170 F, the batch continued to get thicker. Six more portions of the same paraffinic base oil totaling 623.62 grams were added and allowed to mix in. The entire batch was given three passes through a three roll mill with both gaps set at 0.001 inches. The final milled grease had a worked 60 stroke penetration of 284. The dropping point was 581 F. As can be seen, the effect of adding a third heating and cooling cycle was to further increase the dropping point as compared to Example 1. This is in accord with the prior art teaching that additional heating to about 400 F allows the two thickener components (lithium 12-hydroxystearate and di-lithium azelate) to increasingly associate at the molecular level, thereby increasingly imparting the high melting point attributes of the di-lithium azelate.

Example 3

Another lithium complex base grease was made essentially the same as the previous Example 2 grease. Like the previous Example 2 grease, this grease had three heating and cooling steps. The only significant difference was that the amount of azelaic acid relative to the amount of 12-hydroxystearic acid was reduced. The wt/wt ratio of 12-hydroxystearic acid to azelaic acid was increased from 2.89 to 3.71. The amount of stoichiometric excess lithium hydroxide in the final grease was 0.11% (wt).

The grease was made as follows: 751.51 grams of a solvent neutral group 1 paraffinic base oil having a viscosity of about 600 SUS at 100 F were added to an open mixing vessel. Then 7.47 grams of an aryl amine antioxidant were added, and mixing began using a planetary mixing paddle. The mixture was heated using a rheostat controlled electric heating mantle until the temperature was 180 F. Then 155.26 grams of 12-hydroxystearic acid were added and allowed to melt and mix into the mixture. At this point, 43.37 grams of lithium hydroxide monohydrate were added, and the mixture was heated to the range of 190-200 F. Then 12.8 grams water were added. The mixture was allowed to react for 30 minutes during which time it foamed. Although reaction of the acids with the base was clearly occurring, no visible grease structure had formed. After the 30 minutes, the mixture was heated to the range of 280-290 F and then cooled back down to 190-200 F. Cooling was accomplished by removing the heating mantle and stirring in open air. Then 41.85 grams of azelaic acid and 12.5 grams water were added. The batch was stirred for 30 minutes after which it was heated to 400-410 F. This heating step took over one hour to complete. When the target top temperature range was reached and held for 5 minutes, the heating mantle was removed and the batch was mixed in the open air and allowed to cool to 230 F. During this cooling period, as the grease structure formed and became increasingly heavy, 131.23 grams of the same paraffinic base oil were added and allowed to fully mix in. When the batch reached 230 F, it was once again heated to 400-410 F and held there for 5 minutes. Then it was allowed to cool in the same manner as before. As it was cooled to 170 F, the batch continued to get thicker. Five more portions of the same paraffinic base oil totaling 531.69 grams were added and allowed to mix in. The entire batch was given three passes through a three roll mill with both gaps set at 0.001 inches. The final milled grease had a worked 60 stroke penetration of 301. The dropping point was 580 F.

Example 4

Another lithium complex base grease was made essentially the same as the previous Example 3 grease. The only significant difference was that after the 12-hydroxystearic acid had reacted and the first heating (to 280-290 F) and cooling cycle had been completed, the batch was only heated once to 390-400 F. However, this heating and cooling cycle was intentionally done at a slower rate so that it took 3 hours to heat to top temperature and 2 hours to cool from the top temperature to 170 F. The wt/wt ratio of 12-hydroxystearic acid to azelaic acid was 3.71. The amount of stoichiometric excess lithium hydroxide in the final grease was 0.12% (wt).

The grease was made as follows: 761.09 grams of a solvent neutral group 1 paraffinic base oil having a viscosity of about 600 SUS at 100 F were added to an open mixing vessel. Then 7.57 grams of an aryl amine antioxidant were added, and mixing began using a planetary mixing paddle. The mixture was heated using a rheostat controlled electric heating mantle until the temperature was 180 F. Then 155.25 grams of 12-hydroxystearic acid were added and allowed to melt and mix into the mixture. At this point, 43.37 grams of lithium hydroxide monohydrate were added, and the mixture was heated to the range of 190-200 F. Then 12.8 grams water were added. The mixture was allowed to react for 30 minutes during which time it foamed. Although reaction of the acids with the base was clearly occurring, no visible grease structure had formed. After the 30 minutes, the mixture was heated to the range of 280-290 F. This took about 45 minutes. Then the batch was cooled back down to 190-200 F. Cooling was accomplished by removing the heating mantle and stirring in open air. Then 41.86 grams of azelaic acid and 12.9 grams water were added. The batch was stirred for 30 minutes after which it was heated to 400-410 F. This heating step took about 3 hours to complete. When the target top temperature was reached and held for 15 minutes, the rheostat was turned down so as to slowly cool the batch. After about 2 hours the batch had reached 170 F. During that time two more portions of the same paraffinic base oil totaling 196.97 grams were added to the batch. Due to the lateness of the day, the heating mantle was removed and mixing was stopped. The next morning, the batch was mixed and heated back to 170 F (this is not considered an additional heating/cooling cycle). Due to the heaviness of the grease, two more portions of the same paraffinic base oil totaling 235.24 grams were added. The entire batch was given three passes through a three roll mill with both gaps set at 0.001 inches. The final milled grease had a worked 60 stroke penetration of 300. The dropping point was 567 F.

Compositions of Examples 1-4 based on the sum of the unreacted components (not including added water) as well as test data are provided in Table 2.

TABLE 2

Summary of Examples 1-4

| Example | 1 | 2 | 3 | 4 |
|---|---|---|---|---|
| 600 SUS Paraffinic Base Oil % | 84.16 | 85.86 | 85.08 | 82.79 |
| 12-hydroxystearic acid % | 9.33 | 8.33 | 9.34 | 10.77 |
| Lithium Hydroxide Monohydrate % | 2.84 | 2.53 | 2.61 | 3.01 |
| Azelaic acid % | 3.23 | 2.88 | 2.52 | 2.90 |
| Aryl Amine Antioxidant % | 0.45 | 0.40 | 0.45 | 0.53 |
| Ratio of 12-hydroxystearic acid-azelaic acid (wt/wt) | 2.89 | 2.89 | 3.71 | 3.71 |
| Temperature when 12-hydroxystearic acid was added, F. | 180 | 180 | 180 | 180 |
| Temperature when LiOH was added, F. | 180 | 180 | 180 | 180 |
| Order of Addition of LiOH and 12-hydroxystearic acid | 12-hydroxystearic acid first | 12-hydroxystearic acid first | 12-hydroxystearic acid first | 12-hydroxystearic acid first |
| Order of Addition of water and LiOH | LiOH first | LiOH first | LiOH first | LiOH first |
| 12-hydroxystearic acid and azelaic acid Added at about the Same Time? | No | No | No | No |
| Heat to 280-290 F. and cool before adding azelaic acid? | Yes | Yes | Yes | Yes |
| How many heatings to 400-410 F.? | 1 | 2 | 2 | 1 |
| How many heating/cooling cycles total? | 2 | 3 | 3 | 2 |
| Speed of Heating to Maximum Process Temperature | Moderate | Moderate | Moderate | Slow (3 hrs) |
| Cooled from Maximum Process Temperature How? | In air | In air | In air | Slow (2 hrs) |
| % excess LiOH in final grease | 0.06 | 0.05 | 0.11 | 0.12 |
| Unworked Penetration | 277 | 280 | 297 | 299 |
| Worked 60 strokes Penetration | 280 | 284 | 301 | 300 |
| Dropping Point, F. | 503 | 581 | 580 | 567 |
| Dropping Point, C. | 262 | 305 | 304 | 297 |
| Roll Stability at 25 C., 2 hrs: | | | | |
| Initial worked Penetration | 289 | 289 | 295 | 305 |
| Final Worked Penetration | 309 | 317 | 315 | 307 |
| % Change | 6.9 | 9.7 | 6.8 | 0.7 |

TABLE 2-continued

| Summary of Examples 1-4 | | | | |
|---|---|---|---|---|
| Example | 1 | 2 | 3 | 4 |
| Roll Stability at 150 C., 2 hrs: | | | | |
| Initial worked Penetration | 289 | 289 | 295 | 305 |
| Final Worked Penetration | 315 | 313 | 311 | 287 |
| % Change | 9.0 | 8.3 | 5.4 | −5.9 |

The data in Table 2 verifies that when more than one heating cycle to 400 F is used, dropping points of these prior art lithium complex base greases are good, just as the prior art states. In Examples 2 and 3, where there are three total heating and cooling cycles (including two cycles to 400 F), dropping point was about 480 F. In Examples 1 and 4, where two heating cycles (including one cycle to 400 F) were used, dropping point was still much higher in Grease 4 where the total heating time was much longer. Thus, it appears that both the number of times the grease is heated to 400 F and the total temperature-time heating effect is important for improving dropping point. The longer heating and cooling times of Example 4 may be closer to what would be experienced in typical open kettle grease manufacturing equipment. These four greases, and especially Example 4, serve as a baseline for comparison with regard to the next example greases according to various preferred embodiments of the invention.

Example 5

A lithium complex base grease was made using the overall process of the previous Example 4, but with the addition of magnesium sulfonate and other method changes as noted below and in Table 3. The wt/wt ratio of 12-hydroxystearic acid to azelaic acid was 3.71. The amount of stoichiometric excess lithium hydroxide in the final grease was 0.11% (wt).

The grease was made as follows: 745.84 grams of a solvent neutral group 1 paraffinic base oil having a viscosity of about 600 SUS at 100 F were added to an open mixing vessel. Then 7.47 grams of an aryl amine antioxidant were added, and mixing began using a planetary mixing paddle. Then 8.41 grams of a 400 TBN overbased magnesium sulfonate were added. This is the same overbased magnesium sulfonate "A" as described in U.S. Ser. No. 15/593,792. The mixture was stirred for 15 minutes. Then 43.36 grams of lithium hydroxide monohydrate and 25.0 grams water were added, and the mixture was heated to 180 F. Then 155.25 grams of 12-hydroxystearic acid were added and allowed to melt and mix into the mixture. Almost immediately a thick grease structure formed. Then 41.86 grams of azelaic acid were added. The grease structure visibly softened in consistency once the azelaic acid had melted and mixed into the batch. The temperature of the batch was adjusted to 190-200 F and held there for 45 minutes. Then the batch was heated to 400-410 F. This heating step took about 3 hours to complete. When the target top temperature was reached and held for 15 minutes, the rheostat was turned down so as to slowly cool the batch over a 2 hour period. During that time two more portions of the same paraffinic base oil totaling 251.43 grams were added to the batch. Due to the lateness of the day, the heating mantle was removed and mixing was stopped. The next morning, the batch was mixed and heated back to 170 F. Due to the heaviness of the grease, three more portions of the same paraffinic base oil totaling 283.00 grams were added. The entire batch was given three passes through a three roll mill with both gaps set at 0.001 inches. The final milled grease had a worked 60 stroke penetration of 283. The dropping point was 625 F. The wt/wt ratio of 12-hydroxystearic acid/overbased sulfonate was about 20. This ratio is usually determined by the amount of 12-hydroxystearic acid and overbased sulfonate added at the beginning as the lithium complex thickener system is being formed. The only exception to this is when the only overbased sulfonate added as part of this invention is added later after the initial thickener formation reaction has occurred, such as when the only overbased sulfonate is added after top temperature has been reached and after cooling has begun.

Example 6

Another lithium complex base grease was made essentially the same as the previous Example 5 grease. The only significant difference was that the amount of overbased magnesium sulfonate A was about half of what was used in Example 5. The wt/wt ratio of 12-hydroxystearic acid to azelaic acid was 3.72. The amount of stoichiometric excess lithium hydroxide in the final grease was 0.11% (wt). The final milled grease had a worked 60 stroke penetration of 287. The dropping point was 602 F. The wt/wt ratio of 12-hydroxystearic acid/overbased sulfonate was about 40.

Example 7

Another lithium complex base grease was made essentially the same as the previous Example 5 grease. The only significant difference was that the amount of overbased magnesium sulfonate A was about twice what was used in Example 5. The wt/wt ratio of 12-hydroxystearic acid to azelaic acid was 3.71. The amount of stoichiometric excess lithium hydroxide in the final grease was 0.12% (wt). The final milled grease had a worked 60 stroke penetration of 303. The dropping point was 613 F. The wt/wt ratio of 12-hydroxystearic acid/overbased sulfonate was about 10.

Example 8

Another lithium complex base grease was made essentially the same as the previous Example 5 grease. The only difference was that after the three hour heating to a top temperature of 400-410 F, the mixing bowl was removed and immersed almost to the rim in a large container of crushed ice with manual stirring of the batch. This caused a rapid cooling such that the temperature of the batch was reduced to 240 F in 10 minutes. At this point, the mixing bowl was again positioned within the mixer, and the batch was mixed and finished. The wt/wt ratio of 12-hydroxystearic acid to azelaic acid was 3.71. The amount of stoichiometric excess lithium hydroxide in the final grease was 0.11% (wt). The final milled grease had a worked 60 stroke penetration of 299. The dropping point was 580 F. The wt/wt ratio of 12-hydroxystearic acid/overbased sulfonate was about 20.

Example 9

Another lithium complex base grease was made essentially the same as the previous Example 5 grease. The only difference was that the overbased magnesium sulfonate A was not added at the beginning, but after the batch had reached top temperature and was cooled to 255 F. The wt/wt ratio of 12-hydroxystearic acid to azelaic acid was 3.71. The amount of stoichiometric excess lithium hydroxide in the final grease was 0.12% (wt). The wt/wt ratio of 12-hydroxystearic acid/overbased sulfonate was about 20.

The grease was made as follows: 748.18 grams of a solvent neutral group 1 paraffinic base oil having a viscosity of about 600 SUS at 100 F were added to an open mixing vessel. Then 7.54 grams of an aryl amine antioxidant were added, and mixing began using a planetary mixing paddle. The mixture was stirred for 15 minutes. Then 43.36 grams of lithium hydroxide monohydrate and 25.0 grams water were added, and the mixture was heated to 180 F. Then 155.25 grams of 12-hydroxystearic acid were added and allowed to melt and mix into the mixture. Then 41.85 grams of azelaic acid were added. The temperature of the batch was adjusted to 190-200 F and held there for 45 minutes. The batch remained a liquid in consistency. Then the batch was heated to 400-410 F. This heating step took about 3 hours to complete. When the target top temperature was reached and held for 15 minutes, the rheostat was turned down so as to slowly cool the batch over a 2 hour period. When the batch reached a temperature of 255 F, 7.70 grams of a 400 TBN overbased magnesium sulfonate A were added. The batch thickened significantly by this time, so three more portions of the same paraffinic base oil totaling 381.43 grams were added to the batch. Due to the lateness of the day, the heating mantle was removed and mixing was stopped. The next morning, the batch was mixed and heated back to 170 F. Due to the heaviness of the grease, two more portions of the same paraffinic base oil totaling 122.69 grams were added. The entire batch was given three passes through a three roll mill with both gaps set at 0.001 inches. The final milled grease had a worked 60 stroke penetration of 283. The dropping point was 580 F.

Example 10

Another lithium complex base grease was made essentially the same as the previous Example 5 grease. The only significant difference was that the heating and cooling rates after initial thickener reaction was the same as what was done in the Example 1-3 greases. The wt/wt ratio of 12-hydroxystearic acid to azelaic acid was 3.70. The amount of stoichiometric excess lithium hydroxide in the final grease was 0.10% (wt). The wt/wt ratio of 12-hydroxystearic acid/overbased sulfonate was about 20. The final milled grease had a worked 60 stroke penetration of 290. The dropping point was 623 F.

Example 11

Another lithium complex base grease was made essentially the same as the previous Example 5 grease. The only significant difference was that the amount of azelaic acid was reduced to an amount that resulted in a wt/wt ratio of 12-hydroxystearic acid to azelaic acid of 5.78. The amount of lithium hydroxide was also proportionally lowered so that the stoichiometric excess lithium hydroxide in the final grease remained 0.11% (wt). The final milled grease had a worked 60 stroke penetration of 293. The wt/wt ratio of 12-hydroxystearic acid/overbased sulfonate was about 20. The dropping point was 610 F.

Compositions of Examples 5-11 based on the sum of the unreacted components (not including added water) as well as test data are provided in Table 3. Example 4 is also included for ease of comparison.

TABLE 3

Summary of Examples 4-11

| | Example | | | | | | | |
|---|---|---|---|---|---|---|---|---|
| | 4 | 5 | 6 | 7 | 8 | 9 | 10 | 11 |
| 600 SUS Paraffinic Base Oil % | 82.79 | 83.32 | 83.61 | 81.60 | 83.41 | 84.76 | 84.76 | 83.71 |
| Overbased magnesium sulfonate A | 0.00 | 0.55 | 0.24 | 1.05 | 0.49 | 0.50 | 0.50 | 0.55 |
| 12-hydroxystearic acid % | 10.77 | 10.10 | 10.11 | 10.86 | 10.08 | 9.22 | 9.22 | 10.80 |
| Lithium Hydroxide Monohydrate % | 3.01 | 2.82 | 2.82 | 3.03 | 2.81 | 2.58 | 2.58 | 2.53 |
| Azelaic acid % | 2.90 | 2.72 | 2.72 | 2.93 | 2.72 | 2.49 | 2.49 | 1.87 |
| Aryl Amine Antioxidant % | 0.53 | 0.49 | 0.49 | 0.53 | 0.49 | 0.45 | 0.45 | 0.54 |
| Ratio of 12-hydroxystearic acid-azelaic acid (wt/wt) | 3.71 | 3.71 | 3.72 | 3.71 | 3.71 | 3.71 | 3.70 | 5.78 |
| Ratio of 12-hydroxystearic acid to Magnesium sulfonate (wt/wt) | NA | 18.4 | 42.1 | 10.3 | 20.6 | 18.5 | 18.4 | 19.6 |
| Temperature when 12-hydroxystearic acid was added, F. | 180 | 180 | 180 | 180 | 180 | 180 | 180 | 180 |
| Temperature when LiOH was added, F. | 180 | 75 | 75 | 75 | 75 | 75 | 75 | 75 |

TABLE 3-continued

Summary of Examples 4-11

| | Example | | | | | | | |
|---|---|---|---|---|---|---|---|---|
| | 4 | 5 | 6 | 7 | 8 | 9 | 10 | 11 |
| Order of Addition of LiOH and 12-hydroxystearic acid | 12-hydroxy stearic acid first | LiOH first | LiOH first | LiOH first | LiOH first | LiOH first | LiOH first | LiOH first |
| Order of Addition of water and LiOH | LiOH first | $H_2O$ first | $H_2O$ first | $H_2O$ first | $H_2O$ first | $H_2O$ first | $H_2O$ first | $H_2O$ first |
| 12-hydroxystearic acid and azelaic acid Added at about the Same Time? | No | Yes | Yes | Yes | Yes | Yes | Yes | Yes |
| Heat to 280-290 F. and cool before adding azelaic acid? | Yes | No | No | No | No | No | No | No |
| How many heatings to 400-410 F.? | 1 | 1 | 1 | 1 | 1 | 1 | 1 | 1 |
| How many heating/cooling cycles total? | 2 | 1 | 1 | 1 | 1 | 1 | 1 | 1 |
| Speed of Heating to Maximum Process Temperature | Slow (3 hr) | Slow (3 hr) | Slow (3 hr) | Slow (3 hr) | Slow (3 hr) | Slow (3 hr) | Mode rate | Slow (3 hr) |
| Cooled from Maximum Process Temperature How? | Slow (2 hr) | Slow (2 hr) | Slow (2 hr) | Slow (2 hr) | Very fast (ice) | Slow (2 hr) | In air | Slow (2 hr) |
| When was Magnesium sulfonate added? | NA | Beginning | Beginning | Beginning | Beginning | Near End | Beginning | Beginning |
| % excess LiOH in final grease | 0.12 | 0.11 | 0.11 | 0.12 | 0.11 | 0.12 | 0.10 | 0.11 |
| % LiOH Monohydrate based on Worked 60 Stroke Pen of 300 | 3.01 | 2.66 | 2.70 | 3.06 | 2.80 | 2.43 | 2.49 | 2.47 |
| Unworked Penetration | 299 | 282 | 277 | 295 | 293 | 277 | 286 | 284 |
| Worked 60 strokes Penetration | 300 | 283 | 287 | 303 | 299 | 283 | 290 | 293 |
| Dropping Point, F. | 567 | 625 | 602 | 613 | 580 | 580 | 623 | 610 |
| Dropping Point, C. | 297 | 329 | 317 | 323 | 304 | 304 | 328 | 321 |
| Roll Stability at 25 C., 2 hrs: | | | | | | | | |
| Initial worked Penetration | 305 | 285 | 289 | 297 | 301 | 287 | 285 | 299 |
| Final Worked Penetration | 307 | 323 | 325 | 323 | 315 | 301 | 295 | 303 |
| % Change | 0.7 | 13.3 | 12.5 | 8.8 | 4.7 | 4.9 | 3.5 | 1.3 |
| Roll Stability at 150 C., 2 hrs: | | | | | | | | |
| Initial worked Penetration | 305 | 285 | 289 | 297 | 301 | 287 | 285 | 299 |
| Final Worked Penetration | 287 | 311 | 305 | 317 | 295 | 277 | 293 | 297 |
| % Change | −5.9 | 9.1 | 5.5 | 6.7 | −2.0 | −3.5 | 2.8 | −0.7 |

As can be seen, the dropping points of the Example 5-11 greases were all as good as or better than the Example 4 grease. In fact, the dropping points of the Example 5-11 greases were all as good as or better than all the Example 1-4 greases (Table 2). It is also noted that the Example 4 grease (and the Example 1-3 greases), had two or more heating and cooling cycles and had separate addition of the two thickener acids with a heating and cooling cycle between each thickener acid addition. The Example 5-11 greases had only one heating and cooling cycle with both thickener acids added at about the same time and without any interim heating or cooling between the additions of the acids. This demonstrates that the use of a relatively small amount of overbased magnesium sulfonate allows only one heating and cooling cycle to be needed with both thickener acids being added at about the same time without suffering a loss of dropping point. By comparing Example 9 to the other greases in Table 3, it appears that adding the overbased magnesium sulfonate after the initial thickener reaction, top heating temperature, and cooling still provides similar benefits to adding it before the initial thickener reaction.

Thickener yield can be qualitatively determined by examining the percent lithium hydroxide monohydrate in the final grease relative to the worked 60 stoke penetration values. Since both thickener acids will be completely neutralized by the lithium hydroxide, a lower lithium hydroxide monohydrate concentration correlates to a lower thickener concentration. Also, since lithium hydroxide monohydrate costs are extremely high, using lithium hydroxide monohydrate concentration is appropriate. By using the customary inverse linear relationship between thickener concentration (as indicated by lithium hydroxide monohydrate concentration) and penetration value, an estimated value of the percent lithium hydroxide monohydrate can be determined for what each grease would have had if more or less base oil had been used to bring the worked penetration to the same value (300) as the Example 4 grease. Those estimated lithium hydroxide concentrations are provided in Table 3. As can be seen, all the Example 5-11 greases had significantly improved thickener yield compared to the Example 4 grease except for Example 7, which used a higher concentration of overbased magnesium sulfonate A than any of the other greases. Based on the thickener yield of Example 7, it appears that using too much overbased magnesium sulfonate A may result in diminished thickener yield even though dropping point will still be high.

It is also noted that the Example 11 grease had a dropping point higher than any of the prior art-based Example 1-4 greases, even though it had a much lower level of azelaic acid relative to 12-hydroxystearic acid, as evidenced by the 12-hydroxystearic acid/azelaic acid ratio value. This is particularly significant since it is the azelaic acid that imparts a dropping point that is higher than a simple lithium soap grease. The use of overbased magnesium sulfonate is appears to be facilitating a more efficient interaction of the two thickener components, thereby magnifying the dropping point enhancing power of the azelaic acid even though less azelaic acid is used. The thickener yield of the Example 11 grease was also excellent, as indicated by the adjusted percentage of lithium hydroxide monohydrate.

By examining the results of Example 8 compared to Example 5, it is apparent that rapid cooling of the grease from its top temperature does not impart any additional benefit. This means that optimum thickener yield and dropping point are not dependent on special equipment or process steps that require such rapid cooling. Similarly, comparing Example 10 with Example 5 shows that high dropping points can be obtained when using a variety of heating and cooling rates.

Shear stability as indicated by the roll stability data show that all the greases had acceptable performance in this test. The Example 11 grease with the lowest relative level of azelaic acid was particularly good in this regard.

Example 12

Another lithium complex base grease was made essentially the same as the previous Example 11 grease. The only significant difference was that this grease had the amount of lithium hydroxide reduced to a level that was 10% (wt) less than what was required to fully neutralize both thickener acids. All previous examples had a slight stoichiometric excess of lithium hydroxide relative to what is required to fully neutralize all the acids. The wt/wt ratio of 12-hydroxystearic acid to azelaic acid was 5.78. This grease behaved noticeably different from all the previous greases in that the grease was visibly softer from the time it reached top temperature and was cooled. The initial base oil added was all that was required; no additional base oil was added. The final milled grease had a worked 60 stroke penetration of 294. The dropping point was 620 F.

Since, the lithium hydroxide was intentionally reduced below its stoichiometric required value in this Example 12 grease, using the percentage lithium hydroxide monohydrate is not a valid parameter for determining relative thickener yield. However, the percentage of 12-hydroxystearic and azelaic acids can be used. For this Example 12 grease the % 12-hydroxystearic acid was 15.26; the % azelaic acid was 2.64. Comparing these values to those in Table 3 for the Example 11 grease (which had almost the same 60 stroke worked penetration as compared to Example 12), it is apparent that the thickener yield of this Example 12 grease was much lower than Example 11. This result is very significant. It shows that when overbased magnesium sulfonate and the aqueous dispersion of lithium hydroxide are present when the two complexing acids are added, the acids react with the lithium hydroxide and leave the basic components of the overbased magnesium sulfonate essentially untouched as long as there is enough lithium hydroxide to fully react with all the added acids. If this was not true, then there would not be such a large difference in thickener yield between Example 11 (where a slight stoichiometric excess of lithium hydroxide was present) and Example 12 (where the lithium hydroxide was only 90% of what was required). Even so, the dropping point of the Example 12 grease was excellent and it used less lithium hydroxide (which is an expensive ingredient) than Example 11. Thus, according to another preferred embodiment, less than a stoichiometric amount of lithium hydroxide is used to make a sulfonate modified lithium grease.

Example 13

Another lithium complex base grease was made essentially the same as the previous Example 5 grease. The only significant difference was that a 400 TBN overbased calcium sulfonate was used instead of the 400 TBN overbased magnesium sulfonate A. The 400 TBN calcium sulfonate was a poor quality overbased calcium sulfonate as defined in the '406 patent. The wt/wt ratio of 12-hydroxystearic acid to azelaic acid was 3.71. The amount of stoichiometric excess lithium hydroxide in the final grease was 0.12% (wt).

The grease was made as follows: 746.85 grams of a solvent neutral group 1 paraffinic base oil having a viscosity of about 600 SUS at 100 F were added to an open mixing vessel. Then 7.63 grams of an aryl amine antioxidant were added, and mixing began using a planetary mixing paddle. Then 7.76 grams of a 400 TBN overbased calcium sulfonate were added. The 400 TBN calcium sulfonate was a poor quality overbased calcium. The mixture was stirred for 15 minutes. Then 43.35 grams of lithium hydroxide monohydrate and 25.14 grams water were added, and the mixture was heated to 180 F. Then 155.24 grams of 12-hydroxystearic acid were added and allowed to melt and mix into the mixture. Almost immediately a thick grease structure formed. Then 41.86 grams of azelaic acid were added. The grease structure visibly softened in consistency once the azelaic acid had melted and mixed into the batch. The temperature of the batch was adjusted to 190-200 F and held there for 45 minutes. Then the batch was heated to 400-410 F. This heating step took about 3 hours to complete. When the target top temperature was reached and held for 15 minutes, the rheostat was turned down so as to slowly cool the batch over a 2 hour period. During that time three more portions of the same paraffinic base oil totaling 305.93 grams were added to the batch.

Due to the lateness of the day, the heating mantle was removed and mixing was stopped. The next morning, the batch was mixed and heated back to 170 F (this is not considered another heat/cooling cycle, since the batch was only reheated to allow mixing following an overnight break in the processing). Due to the heaviness of the grease, 176.89 grams of the same paraffinic base oil were added. The entire batch was given three passes through a three roll mill with both gaps set at 0.001 inches. The final milled grease had a worked 60 stroke penetration of 279. The dropping point was 600 F. The lithium hydroxide monohydrate concentration in the final grease, as calculated in the previous example greases was 2.92% (based on the weight of all unreacted ingredients, excluding the weight of water). This result is surprising in that it shows that overbased calcium sulfonates also have the ability to provide the same benefits as overbased magnesium sulfonates regarding the formulation and manufacture of improved lithium complex greases according to various preferred embodiments of the invention.

Example 14

Another lithium complex base grease was made essentially the same as the previous Example 13 grease. The only significant difference was that this grease used about 20 times as much of the same poor quality overbased calcium sulfonate as the previous Example 13 grease. This meant that the final concentration of the overbased calcium sulfonate would have been about 10% (wt), assuming the same amount of base oil was added during the manufacturing process. Since less base oil was added to this grease compared to the Example 13 grease, the concentration of overbased calcium sulfonate in the final product was 12.41%. Likewise, the amount of stoichiometric excess lithium hydroxide in the final grease product was 0.14% (wt). The wt/wt ratio of 12-hydroxystearic acid to azelaic acid was 3.71. The wt/wt ratio of 12-hydroxystearic acid/overbased sulfonate was 1.0.

The batch was made as follows: 660.31 grams of a solvent neutral group 1 paraffinic base oil having a viscosity of about 600 SUS at 100 F were added to an open mixing vessel. Then 7.92 grams of an aryl amine antioxidant were added, and mixing began using a planetary mixing paddle. Then 150.69 grams of a 400 TBN overbased calcium sulfonate were added. The 400 TBN calcium sulfonate was a poor quality overbased calcium sulfonate as defined in U.S. Pat. No. 9,458,406. The mixture was stirred for 15 minutes. Then 43.35 grams of lithium hydroxide monohydrate and 25.02 grams water were added, and the mixture was heated to 180 F. Then 155.25 grams of 12-hydroxystearic acid were added and allowed to melt and mix into the mixture. Then 41.89 grams of azelaic acid were added. Unlike the previous lithium hydroxide base grease examples where an overbased sulfonate was used, the grease structure of this grease did not soften in consistency once the azelaic acid had melted and mixed into the batch. Instead, it continued to thicken. The temperature of the batch was adjusted to 190-200 F and held there for 45 minutes. During this time, the batch became sufficiently heavy that three portions of the same paraffinic base oil totaling 191.15 grams were added.

Then the batch was heated to 400-410 F. This heating step took about 3 hours to complete. During this heating step, when the batch reached about 280 F, it began to become progressively softer. By the time the batch reached 300 F, it was a liquid with no discernable grease structure. By the time the batch reached about 360 F, a significant layer of foam had developed. This remained all the way to the top temperature. When the target top temperature was reached, the rheostat was turned down so as to slowly cool the batch to 170 F over a 2 hour period. The batch never recovered its grease structure. A portion of the final liquid mixture at 170 F was given three passes through a three roll mill with both gaps set at 0.001 inches. The mixture remained a liquid and was not significantly thickened by the milling process. The initial grease structure had been entirely lost. This example demonstrates that using overbased calcium sulfonate in excess of 10% (wt) and/or using a ratio of 12-hydroxystearic acid to overbased calcium sulfonate of 1 or less may result in failure to form a sufficient grease structure. Accordingly, it is preferred that the amount of overbased calcium sulfonate used be less than 10% and that the ratio of 12-hydroxystearic acid to overbased calcium sulfonate must be greater than 1. The amount of overbased sulfonate used in calculating this ratio will typically be the amount added before the thickener formation reaction occurs. However, if no overbased sulfonate is added at that time, but is added later after the thickener formation has occurred (such as after heating to top temperature and after cooling has begun), then the amount of overbased sulfonate used to calculate this ratio will be the amount added as such a later point in the process.

Example 15

Another lithium complex base grease was made essentially the same as the previous Example 14 grease. Like the Example 14 grease, this grease used the same high amount of overbased calcium sulfonate, (about 20 times as much of the same poor quality overbased calcium sulfonate as the previous Example 13 grease). This meant that the final concentration of the overbased calcium sulfonate in this Example 15 would have been about 10% (wt), assuming the same amount of base oil that was used in the Example 13 grease was added during the manufacturing process. Likewise, the amount of stoichiometric excess lithium hydroxide in the final grease would have been 0.11% (wt) if the same amount of base oil had been added during the manufacturing process. The wt/wt ratio of 12-hydroxystearic acid to azelaic acid was 3.71. The wt/wt ratio of 12-hydroxystearic acid/overbased sulfonate was 1.0. The only significant difference between this Example 15 grease and the previous Example 14 grease was that this grease used a good quality overbased calcium sulfonate as defined in the '406 patent.

The grease was made as follows: 662.07 grams of a solvent neutral group 1 paraffinic base oil having a viscosity of about 600 SUS at 100 F were added to an open mixing vessel. Then 7.61 grams of an aryl amine antioxidant were added, and mixing began using a planetary mixing paddle. Then 150.88 grams of a 400 TBN overbased calcium sulfonate were added. The 400 TBN calcium sulfonate was a good quality overbased calcium sulfonate as defined in U.S. Pat. No. 9,458,406. The mixture was stirred for 15 minutes. Then 43.35 grams of lithium hydroxide monohydrate and 24.98 grams water were added, and the mixture was heated to 180 F. Then 155.27 grams of 12-hydroxystearic acid were added and allowed to melt and mix into the mixture. Like the previous Example 14 grease, nothing happened immediately. However, after about 5 minutes of mixing a thick grease structure suddenly formed. Then 41.87 grams of azelaic acid were added. Once again, like the previous Example 14 grease, the grease structure of this grease did not soften in consistency once the azelaic acid had melted and mixed into the batch. Instead, it continued to thicken. The temperature of the batch was adjusted to 190-200 F and held there for 45 minutes. During this time, the batch became sufficiently heavy that four portions of the same paraffinic base oil totaling 347.37 grams were added. Then the batch was heated to 400-410 F. This heating step took about 3 hours to complete. During this heating step, when the batch reached about 280 F, it began to become progressively softer. By the time the batch reached 340 F, it was a liquid with little or no discernable grease structure. However, unlike the previous Example 14 batch, no foam developed during the heating to top temperature. When the target top temperature was reached, the rheostat was turned down so as to slowly cool the batch to 170 F over a 2 hour period. By the time the batch reached 300 F, it began to recover some of its grease structure. When the grease reached 170 F, it had become a very soft appearing grease. A portion of this grease was given three passes through a three roll mill with both gaps set at 0.001 inches. The composition and unworked penetration of this milled grease are provided below in Table 4.

TABLE 4

Summary of Example 15

| Example | 15 |
|---|---|
| 600 SUS Paraffinic Base Oil % | 71.67 |
| Overbased calcium sulfonate (good quality) | 10.71 |
| 12-hydroxystearic acid % | 11.02 |
| Lithium Hydroxide Monohydrate % | 3.03 |
| Azelaic acid % | 2.97 |
| Aryl Amine Antioxidant % | 0.54 |
| Ratio of 12-hydroxystearic acid-azelaic acid (wt/wt) | 3.71 |
| Ratio of 12-hydroxystearic acid to Magnesium sulfonate (wt/wt) | 1.0 |
| Temperature when 12-hydroxystearic acid was added, F. | 180 |
| Temperature when LiOH was added, F. | 75 |
| Order of Addition of LiOH and 12-hydroxystearic acid | LiOH first |
| Order of Addition of water and LiOH | $H_2O$ first |
| 12-hydroxystearic acid and azelaic acid Added at about the Same Time? | Yes |
| Heat to 280-290 F. and cool before adding azelaic acid? | No |
| How many heatings to 400-410 F.? | 1 |
| Speed of Heating to Maximum Process Temperature | Slow (3 hr) |
| Cooled from Maximum Process Temperature How? | Slow (2 hr) |
| Unworked Penetration | 367 |

The unworked penetration of this grease corresponds to an NLGI No. 0 grade. The dropping point was not determined since greases of this consistency usually run out of the dropping point cup at a very low temperature. This example demonstrates that there is a difference between how the good and poor quality overbased calcium sulfonates behave when in various compositions. Unlike the previous Example 14 which used a poor quality overbased calcium sulfonate, this Example 15 resulted in a grease even when the % (wt) overbased sulfonate was about 10.0 and when the ratio of 12-hydroxystearic acid/overbased sulfonate was 1.0. However, the grease was very soft. It should also be pointed out that the Fourier Transform Infrared (FTIR) spectrum of this grease showed that the calcium carbonate from the good quality overbased calcium sulfonate was almost entirely present as its original amorphous form. There was only a slightly measurable trace of conversion to crystalline calcium carbonate, but it was not enough to have contributed to the soft grease structure that formed.

Additionally, with the amount of lithium hydroxide monohydrate and overbased calcium sulfonate used, the cost of such a grease like Example 15 would be extremely high. If one wanted to make a grease like this one, but with a harder consistency (such as an NLGI No. 2), the higher amount of lithium complex thickener required would cause the cost to be even higher.

Example 16

Another lithium complex base grease was made the same as the previous Example 15 grease. The only significant difference was that instead of a 400 TBN overbased calcium sulfonate, the 400 TBN magnesium sulfonate A was used. This meant that the final concentration of the overbased magnesium sulfonate in this Example 16 would have been about 10% (wt), assuming the same amount of base oil that was used in the Example 13 grease was added during the manufacturing process. Likewise, the amount of stoichiometric excess lithium hydroxide in the final grease would have been 0.11% (wt) if the same amount of base oil had been added during the manufacturing process. The wt/wt ratio of 12-hydroxystearic acid to azelaic acid was 3.71. The wt/wt ratio of 12-HSA/overbased sulfonate was 1.0.

The batch was made as follows: 661.58 grams of a solvent neutral group 1 paraffinic base oil having a viscosity of about 600 SUS at 100 F were added to an open mixing vessel. Then 7.71 grams of an aryl amine antioxidant were added, and mixing began using a planetary mixing paddle. Then 151.29 grams of 400 TBN overbased magnesium sulfonate A were added. The mixture was stirred for 15 minutes. Then 43.35 grams of lithium hydroxide monohydrate and 25.04 grams water were added, and the mixture was heated to 180 F. Then 155.26 grams of 12-hydroxystearic acid were added and allowed to melt and mix into the mixture. Like the previous Example 15 grease, nothing happened immediately. However, after about 5 minutes of mixing, visible signs of reaction had still not occurred. Then 41.87 grams of azelaic acid were added. Almost immediately, foaming began as the level of the batch began to rise in the mixer. After another 10 minutes, the foam had subsided and a grease structure was evident. The temperature of the batch was adjusted to 190-200 F and held there for 45 minutes. During this time, the batch became sufficiently heavy that five portions of the same paraffinic base oil totaling 267.21 grams were added. Then the batch was heated to 400-410 F. This heating step took about 3 hours to complete. During this heating step, when the batch reached about 280 F, it began to become progressively softer. By the time the batch reached 340 F, it was a liquid with little or no discernable grease structure. However, unlike the previous Example 14 batch, no foam developed during the heating to top temperature. When the target top temperature was reached, the rheostat was turned down so as to slowly cool the batch to 170 F over a 2 hour period. The batch remained very thin with no grease structure. Repeated passes through a three roll mill with both gaps set at 0.001 inches did nothing to thicken the product. No significant grease structure had formed.

Examples 14-16 indicate that the amount of overbased sulfonate, whether calcium sulfonate, magnesium sulfonate, or a combination thereof, used is preferably in an amount that is less than 10% by weight of the grease ingredients (excluding the weight of water) and that the ratio of 12-hydroxystearic acid (or other monocarboxylic acid) to overbased sulfonate be greater than 1.

Example 17

A lithium complex base grease was made the same as previous Example 11. The wt/wt ratio of 12-hydroxystearic acid to azelaic acid was 5.75. The wt/wt ratio of 12-hydroxystearic acid/overbased sulfonate was 24.9. A weighed portion of this base grease was placed in an appropriate sized steel can along with weighed portions of various additives. This mixture was mixed well by hand using a steel spatula. Then the mixture was placed in a forced air convection oven held at 212 F. The steel can was periodically removed, and the grease mixture was stirred by hand using the steel spatula. Once the temperature of the stirred grease mixture was 170 F, it was given three passes through a three roll mill with both gaps set at 0.001 inches. The amount of stoichiometric excess lithium hydroxide in the final milled grease was 0.10% (wt). The final composition and test properties of this grease are provided below in Table 5.

TABLE 5

Summary of Example 17

| Example | 17 |
|---|---|
| 600 SUS Paraffinic Base Oil % | 72.11 |
| Overbased magnesium sulfonate A | 0.39 |
| 12-hydroxystearic acid % | 9.72 |
| Lithium Hydroxide Monohydrate % | 2.29 |
| Azelaic acid % | 1.69 |
| Alkenyl amide borate | 0.50 |
| Aryl Amine Antioxidant % | 0.39 |
| Zinc dialkyl dithiocarbamate | 2.50 |
| Zinc di-alky dithiophosphate | 0.20 |
| Acrylate-based co-polymer | 0.20 |
| Calcium carbonate | 5.00 |
| Anhydrous Calcium Sulfate | 5.00 |
| Ratio of 12-hydroxystearic acid-azelaic acid (wt/wt) | 5.75 |
| Ratio of 12-hydroxystearic acid to Magnesium sulfonate (wt/wt) | 24.9 |
| Temperature when 12-hydroxystearic acid was added, F. | 180 |
| Temperature when LiOH was added, F. | 75 |
| Order of Addition of LiOH and 12-hydroxystearic acid | LiOH first |
| Order of Addition of water and LiOH | $H_2O$ first |
| 12-hydroxystearic acid and azelaic acid Added at about the Same Time? | Yes |
| Heat to 280-290 F. and cool before adding azelaic acid? | No |
| How many heatings to 400-410 F.? | 1 |
| Speed of Heating to Maximum Process Temperature | Slow (3 hr) |
| Cooled from Maximum Process Temperature How? | Slow (2 hr) |
| Unworked Penetration | 281 |
| Worked 60 strokes Penetration | 285 |
| Dropping Point, F. | 591 |
| Dropping Point, C | 311 |
| Copper Strip Corrosion 24 hrs, 100 C. | 1A/1B |
| Cone Oil Separation, 24 hrs, 100 C. | 1.6 |
| Cone Oil Separation, 24 hrs, 150 C. | 2.2 |
| Four Ball Wear, mm | 0.43 |
| Four Ball EP, Weld Load, kg | 620 |
| Roll Stability at 25 C., 2 hrs: | |
| Initial worked Penetration | 285 |
| Final Worked Penetration | 299 |
| Dropping Point After Test, F. | 581 |
| % Change | 4.9 |
| Roll Stability at 150 C., 2 hrs: | |
| Initial worked Penetration | 285 |
| Final Worked Penetration | 291 |
| Dropping Point After Test, F. | 580 |
| % Change | 2.1 |

The added calcium carbonate and anhydrous calcium sulfate were of food grade purity and had a mean particle size below 5 microns. As can be seen, the Example 17 grease had an excellent dropping point, shear stability, oil separation properties, extreme pressure/antiwear (EP/AW) properties, and was passive to copper even when tested at 150 C. The test data of Table 5 demonstrate that the compositions and methods of preferred embodiments of the invention are not limited to base lithium complex greases, but are also fully applicable to finished, additized greases formulated for high performance. The low level of lithium hydroxide monohydrate, the much more favorable ratio of 12-hydroxystearic acid/azelaic acid, and the use of only one heating and cooling cycle compared to the Example 1-4 greases demonstrate again the ability of preferred compositions and methods of the invention to provide good quality lithium complex greases with improved thickener yield and/or dropping point.

Example 18

Another lithium complex grease was made. Again the wt/wt ratio of 12-hydroxystearic acid to azelaic acid was 5.78. The wt/wt ratio of 12-hydroxystearic acid/overbased sulfonate was 24.8. The amount of stoichiometric excess lithium hydroxide in the final grease was 0.10% (wt). This grease used a 400 TBN overbased calcium sulfonate instead of a 400 TBN overbased magnesium sulfonate. The 400 TBN calcium sulfonate was the same good quality overbased calcium sulfonate as used in the previous Example 15 grease.

The grease was made as follows: 642.53 grams of a solvent neutral group 1 paraffinic base oil having a viscosity of about 600 SUS at 100 F were added to an open mixing vessel. Then 6.01 grams of an aryl amine antioxidant were added, and mixing began using a planetary mixing paddle. Then 7.64 grams of a 400 TBN overbased calcium sulfonate were added. The 400 TBN calcium sulfonate was a good quality overbased calcium sulfonate as defined in the '406 patent. The mixture was stirred for 15 minutes. Then 44.56 grams of lithium hydroxide monohydrate and 25.06 grams water were added, and the mixture was heated to 180 F. Then 189.60 grams of 12-hydroxystearic acid were added and allowed to melt and mix into the mixture. Almost immediately a thick grease structure formed. Then 32.86 grams of azelaic acid were added. The grease structure visibly softened in consistency once the azelaic acid had melted and mixed into the batch. The temperature of the batch was adjusted to 190-200 F and held there for 45 minutes. Then the batch was heated to 400-410 F. This heating step took about 3 hours to complete. When the target top temperature was reached and held for 15 minutes, the rheostat was turned down so as to slowly cool the batch over a 2 hour period. During that time, the batch continued to become increasingly heavy.

When the batch reached 290 F, 148.50 grams of the same paraffinic base oil was added. When the batch reached 250 F, 75.01 grams of calcium carbonate and 75.18 grams of anhydrous calcium sulfonate were added. The calcium carbonate and the anhydrous calcium sulfonate were of food grade purity and had a mean particle size below 5 microns. As the batch continued to become increasingly heavy, three portions of the same base oil totaling 273.13 grams were added. When the batch reached 200 F, the following additives were added: 7.56 grams of an alkenyl borated amide; 4.57 grams of a sulfurized polyisobutylene; 3.05 grams of a zinc dialkyl dithiophosphate; 37.47 grams of a zinc dialkyl dithiocarbamate; 3.07 grams of an acrylate-based co-polymer; and 15.24 grams of a polyalphaolefin (PAO) having a viscosity of 4 cSt at 100 C. Due to the lateness of the day, the heating mantle was removed and mixing was stopped. The next morning, the batch was mixed and heated back to 170 F. Due to the heaviness of the grease, two more portions of the same paraffinic base oil totaling 179.69 grams of the same paraffinic base oil were added. The entire batch was given three passes through a three roll mill with both gaps set at 0.001 inches. The final milled grease had a worked 60 stroke penetration of 277. The dropping point was 557 F. The lithium hydroxide monohydrate concentration in the final grease, as calculated in the previous example greases was 2.55%.

Example 19

Another lithium complex grease was made similar to the previous Example 18 grease. The primary difference was that this grease not only used the same good quality 400 TBN overbased calcium sulfonate, it also used a small amount of overbased magnesium sulfonate A. Again the wt/wt ratio of 12-hydroxystearic acid to azelaic acid of 5.77. The wt/wt ratio of 12-hydroxystearic acid/total overbased sulfonate (calcium and magnesium) was 18.9. The amount of stoichiometric excess lithium hydroxide in the final grease was 0.12% (wt).

The grease was made as follows: 641.17 grams of a solvent neutral group 1 paraffinic base oil having a viscosity of about 600 SUS at 100 F were added to an open mixing vessel. Then 6.23 grams of an aryl amine antioxidant were added, and mixing began using a planetary mixing paddle. Then 7.79 grams of a 400 TBN overbased calcium sulfonate were added. The 400 TBN calcium sulfonate was a good quality overbased calcium sulfonate as defined in U.S. Pat. No. 9,458,406. Then 2.23 grams of overbased magnesium sulfonate A were added. The mixture was stirred for 15 minutes. Then 44.53 grams of lithium hydroxide monohydrate and 25.04 grams water were added, and the mixture was heated to 180 F. Then 189.57 grams of 12-hydroxystearic acid were added and allowed to melt and mix into the mixture. Almost immediately a thick grease structure formed. Then 32.85 grams of azelaic acid were added. The grease structure visibly softened in consistency once the azelaic acid had melted and mixed into the batch. The temperature of the batch was adjusted to 190-200 F and held there for 45 minutes. Then the batch was heated to 400-410 F. This heating step took about 3 hours to complete. During this heating step, the batch continued to become increasingly heavy.

When the temperature of the grease reached 325 F, another 42.26 grams of the same paraffinic base oil were added. When the target top temperature was reached and held for 15 minutes, the rheostat was turned down so as to slowly cool the batch over a 2 hour period. During that time, the batch continued to become increasingly heavy. When the batch reached 290 F, two portions of the same paraffinic base oil totaling 114.57 grams were added. When the batch reached 250 F, 75.04 grams of calcium carbonate and 75.03 grams of anhydrous calcium sulfonate were added. The calcium carbonate and the anhydrous calcium sulfonate both had a mean particle size below 5 microns. When the batch reached 200 F, the following additives were added: 7.50 grams of an alkenyl borated amide; 4.66 grams of a sulfurized polyisobutylene; 3.05 grams of a zinc dialkyl dithiophosphate; 37.52 grams of a zinc dialkyl dithiocarbamate; 3.21 grams of a acrylate-based co-polymer; and 15.63 grams of a polyalphaolefin (PAO) having a viscosity of 4 cSt at 100 C. Another 99.10 grams of the same base oil was added and allowed to mix in. Due to the lateness of the day, the heating mantle was removed and mixing was stopped. The next morning, the batch was mixed and heated back to 170 F. Another 29.99 grams of the same paraffinic base oil were added. The entire batch was given three passes through a three roll mill with both gaps set at 0.001 inches. The final milled grease had a worked 60 stroke penetration of 285. The dropping point was 535 F. The lithium hydroxide monohydrate concentration in the final grease, as calculated in the previous example greases was 2.96%.

Various ingredients and methodologies to make overbased calcium sulfonate greases and overbased calcium magnesium sulfonate greases as described in the '265 and '406 patents and U.S. patent application Ser. Nos. 14/990,473, 15/130,422, 15/593,792, 15/593,839, and 15/593,912, which are incorporated herein by reference, may be useful in making lithium carboxylate greases modified with overbased sulfonate according to various preferred embodiments of the invention.

As used herein, amounts of ingredients identified by percentages or parts are the amounts added as an ingredient by weight relative to the total weight of all ingredients added, excluding the weight of water added. All penetration tests are done according to ASTM D217 or D1403 as commonly used in lubricating grease manufacturing. In like manner, as used herein the "dropping point" of a grease shall refer to the value obtained by using the standard dropping point test ASTM D2265 as commonly used in lubricating grease manufacturing. Four Ball EP tests as described herein shall refer to ASTM D2596. Four Ball Wear tests as described herein shall refer to ASTM D2266. Cone Oil Separation tests as described herein shall refer to ASTM D6184. Roll Stability tests as described herein shall refer to ASTM D1831. Those of ordinary skill in the art will appreciate upon reading this specification, including the examples contained herein, that modifications and alterations to the composition and methodology for making the composition may be made within the scope of the invention and it is intended that the scope of the invention disclosed herein be limited only by the broadest interpretation of the appended claims to which the inventor is legally entitled.

I claim:

1. A method for making a lithium carboxylate grease comprising the steps of:

adding and mixing an overbased calcium sulfonate or an overbased magnesium sulfonate or both with a base oil, lithium hydroxide, and water;

wherein the lithium carboxylate grease is a simple grease or a complex grease.

2. The method according to claim 1 wherein the lithium carboxylate grease is a complex grease and further comprising the step of adding and mixing one or more monocarboxylic acids and one or more dicarboxylic acids.

3. The method according to claim 2 wherein the monocarboxylic acid and dicarboxylic acid are added in a wt/wt ratio of monocarboxylic acid to dicarboxylic acid of 3.7 or greater.

4. The method according to claim 2 wherein the monocarboxylic acid and dicarboxylic acid are added in a wt/wt ratio of monocarboxylic acid to dicarboxylic acid of 5 or greater.

5. The method according to claim 2 wherein the acids are 12-hydroxystearic acid and azelaic acid and wherein the azelaic acid is added in an amount less than an amount of 12-hydroxystearic acid added.

6. The method according to claim 2 wherein the lithium hydroxide is added in an amount that is less than the amount stoichiometrically needed to react with monocarboxylic and dicarboxylic acids.

7. The method according to claim 2 wherein the grease has a dropping point greater than 540 F.

8. The method according to claim 2 wherein the grease has a dropping point greater than 600 F.

9. The method according to claim 2 further comprising adding and mixing a calcium containing base.

10. The method according to claim 9 wherein the calcium containing base is one or more of calcium hydroxyapatite, added calcium carbonate, added calcium hydroxide, or added calcium oxide.

11. The method according to claim 2 wherein the monocarboxylic acid and dicarboxylic acid are added at substantially the same time.

12. The method according to claim 2 wherein the monocarboxylic acid is added prior to the dicarboxylic acid and a mixture comprising the monocarboxylic acid is not heated and cooled prior to adding the dicarboxylic acid.

13. The method according to claim 2 wherein the monocarboxylic acid is added and then the dicarboxylic acid is added as the next sequential ingredient.

14. The method according to claim 2 further comprising heating the ingredients to a maximum processing temperature only once.

15. The method according to claim 14 wherein the maximum processing temperature is around 390 F-430 F.

16. The method according to claim 2 wherein the overbased calcium sulfonate, overbased magnesium sulfonate, or both are mixed with the base oil to form a first mixture; and wherein the lithium hydroxide and water are added to the first mixture to form a second mixture.

17. The method according to claim 16 wherein the monocarboxylic and dicarboxylic acids are added to the second mixture to form a third mixture.

18. The method according to claim 17 further comprising heating the first mixture to around 160 F-200 F prior to adding the lithium hydroxide.

19. The method according to claim 18 further comprising heating the third mixture to around 190 F-200 F and holding the third mixture in that temperature range until a reaction between the acids and lithium hydroxide is complete to form a fourth mixture.

20. The method according to claim 19 further comprising heating the fourth mixture to around 390 F-430 F and then cooling the fourth mixture.

21. The method according to claim 2 wherein no esters are added.

22. The method according to claim 2 wherein no alcohol by-products are formed.

23. The method according to claim 2 wherein there is a single heating and cooling cycle.

24. The method according to claim 2 wherein the ingredients are mixed in an open vessel.

25. A lithium carboxylate grease composition comprising the following ingredients: overbased magnesium sulfonate, overbased calcium sulfonate, or a combination thereof;

lithium hydroxide; and a base oil; and wherein the lithium carboxylate grease is a simple grease or a complex grease.

26. The composition according to claim 25 wherein the grease is a complex grease and further comprising one or more monocarboxylic acids and one or more dicarboxylic acids.

27. The composition according to claim 26 wherein the monocarboxylic acid and dicarboxylic acid are in a wt/wt ratio of 3.7 or greater.

28. The composition according to claim 26 wherein the monocarboxylic acid and dicarboxylic acid are in a wt/wt ratio of 5 or greater.

29. The method according to claim 26 wherein the acids are 12-hydroxystearic acid and azelaic acid and wherein the composition comprises more 12-hydroxystearic acid by weight than azelaic acid.

30. The composition according to claim 26 wherein the composition comprises lithium hydroxide in an amount that is less than the amount stoichiometrically needed to react with monocarboxylic and dicarboxylic acids.

31. The composition according to claim 26 wherein the grease has a dropping point greater than 500 F.

32. The composition according to claim 26 wherein the grease has a dropping point greater than 600 F.

33. The composition according to claim 26 further comprising one or more of calcium hydroxyapatite, added calcium carbonate, added calcium hydroxide, or added calcium oxide.

34. The composition according to claim 29 wherein the composition comprises around 1-5% lithium hydroxide, 4.3-21.2% 12-hydroxystearic acid, and 0.8-3.6 azelaic acid, and wherein the percentages are by weight of the total unreacted ingredients excluding the weight of water.

35. The composition according to claim 34 wherein the composition comprises around 0.01-10% total overbased calcium sulfonate, overbased magnesium sulfonate, or a combination thereof, and wherein the percentages are by weight of the total unreacted ingredients excluding the weight of water.

36. The composition according to claim 25 further comprising 12-hydroxystearic acid in a wt/wt ratio of 12-hydroxystearic acid to overbased calcium sulfonate of 1:1 or more.

37. The composition according to claim 30 further comprising one or more of calcium hydroxyapatite, add calcium carbonate, added calcium hydroxide, or added calcium oxide.

38. The method according to claim 1 wherein around 0.01-10% total overbased calcium sulfonate, overbased magnesium sulfonate, or a combination thereof is added, and wherein the percentages are by weight of the total unreacted ingredients excluding the weight of water.

39. The method according to claim 1 further comprising adding 12-hydroxystearic acid after adding the overbased calcium sulfonate and lithium hydroxide and wherein the 12-hydroxystearic acid is added in a wt/wt ratio of 12-hydroxystearic acid to overbased calcium sulfonate of 1:1 or more.

40. The method according to claim 2 wherein the lithium hydroxide is batch added prior to adding the monocarboxylic acid and dicarboxylic acid.

41. The method according to claim 2 wherein the lithium hydroxide is solid lithium hydroxide monohydrate.

42. The method according to claim 40 wherein the lithium hydroxide is solid lithium hydroxide monohydrate.

43. The method according to claim 10 wherein the amount of lithium hydroxide added is stoichiometrically insufficient to neutralize the monocarboxylic acid and dicarboxylic acid added.

44. The method according to claim 23 wherein the monocarboxylic acid and dicarboxylic acid are added in a wt/wt ratio of monocarboxylic acid to dicarboxylic acid of 5 or greater.

45. The method according to claim 1 wherein around 0.1-5% total overbased calcium sulfonate, overbased magnesium sulfonate, or a combination thereof is added, and wherein the percentages are by weight of the total unreacted ingredients excluding the weight of water.

46. The composition according to claim 25 wherein the composition comprises around 0.1-5% total overbased calcium sulfonate, overbased magnesium sulfonate, or a combination thereof, and wherein the percentages are by weight of the total unreacted ingredients excluding the weight of water.

* * * * *